United States Patent [19]

Restall et al.

[11] Patent Number: 4,687,684

[45] Date of Patent: Aug. 18, 1987

[54] PROCESS FOR DIFFUSION COATING METALS

[75] Inventors: James E. Restall, Frimley; Cecil Hayman, Rickmansworth, both of England

[73] Assignee: The Secretary of State for Defence in Her Britannic Majesty's Government of the United Kingdom of Great Britain and Northern Ireland, London, England

[21] Appl. No.: 800,809

[22] Filed: Nov. 22, 1985

[30] Foreign Application Priority Data

Nov. 29, 1984 [GB] United Kingdom ..... 8430129

[51] Int. Cl.[4] ..... C23C 16/06; C23C 16/30

[52] U.S. Cl. ..... 427/248.1; 427/252; 427/253; 427/255.2

[58] Field of Search ..... 427/250, 252, 253, 248.1, 427/255.2, 255.1

[56] References Cited

U.S. PATENT DOCUMENTS

| | | | |
|---|---|---|---|
| 2,856,312 | 10/1958 | Nowak et al. | 427/250 |
| 2,970,068 | 1/1961 | Drummond | 427/253 |
| 3,050,417 | 8/1962 | Nack et al. | 427/252 |
| 3,061,462 | 10/1962 | Samuel | 427/252 |
| 3,083,122 | 3/1963 | Weatherly et al. | 427/253 |
| 3,257,230 | 6/1966 | Wachtell et al. | 427/250 |
| 3,936,539 | 2/1976 | Baldi | 427/253 |
| 4,369,233 | 1/1983 | Schaik | 427/253 |
| 4,467,016 | 8/1984 | Baldi | 427/253 |

FOREIGN PATENT DOCUMENTS

| | | | |
|---|---|---|---|
| 0024802 | 3/1981 | European Pat. Off. | 427/250 |
| 0058571 | 8/1982 | European Pat. Off. | 427/248.1 |
| 820649 | 9/1959 | United Kingdom | 427/253 |
| 915089 | 1/1963 | United Kingdom | 427/253 |
| 1138322 | 1/1969 | United Kingdom | 427/248.1 |
| 1241013 | 7/1971 | United Kingdom | 427/376.2 |
| 1240953 | 7/1971 | United Kingdom | 427/248.1 |
| 1249414 | 10/1971 | United Kingdom | 427/250 |
| 1249933 | 10/1971 | United Kingdom | 427/250 |
| 1256237 | 12/1971 | United Kingdom | 427/250 |
| 1315228 | 5/1973 | United Kingdom | 427/250 |
| 1315229 | 5/1973 | United Kingdom | 427/250 |
| 1328458 | 8/1973 | United Kingdom | 427/252 |
| 1350855 | 4/1974 | United Kingdom | 428/678 |
| 1529441 | 10/1978 | United Kingdom | 427/253 |
| 1526911 | 10/1978 | United Kingdom | 428/678 |
| 1545584 | 5/1979 | United Kingdom | 428/668 |
| 1549845 | 8/1979 | United Kingdom | 427/252 |

OTHER PUBLICATIONS

Walsh, P., "Chemical Aspects of Pack Cementation", Fourth International Congress, pp. 147–168, Oct. 1973.

*Primary Examiner*—Sadie L. Childs

*Attorney, Agent, or Firm*—Stevens, Davis, Miller & Mosher

[57] ABSTRACT

A process for producing a two element deposition coating on metals e.g. for oxidation/corrosion protection of superalloys, comprises halide transfer of the two elements in sequence from a reaction charge, the reaction charge including a significant excess of halide activator over the amount required for stoichiometric considerations. The transportation of the first element is terminated by reacting its source to exhaustion, in the course of the transport reaction or by evacuating from the reaction vessel. Preferred elements are aluminum with silicon and aluminum with chromium.

20 Claims, 1 Drawing Figure

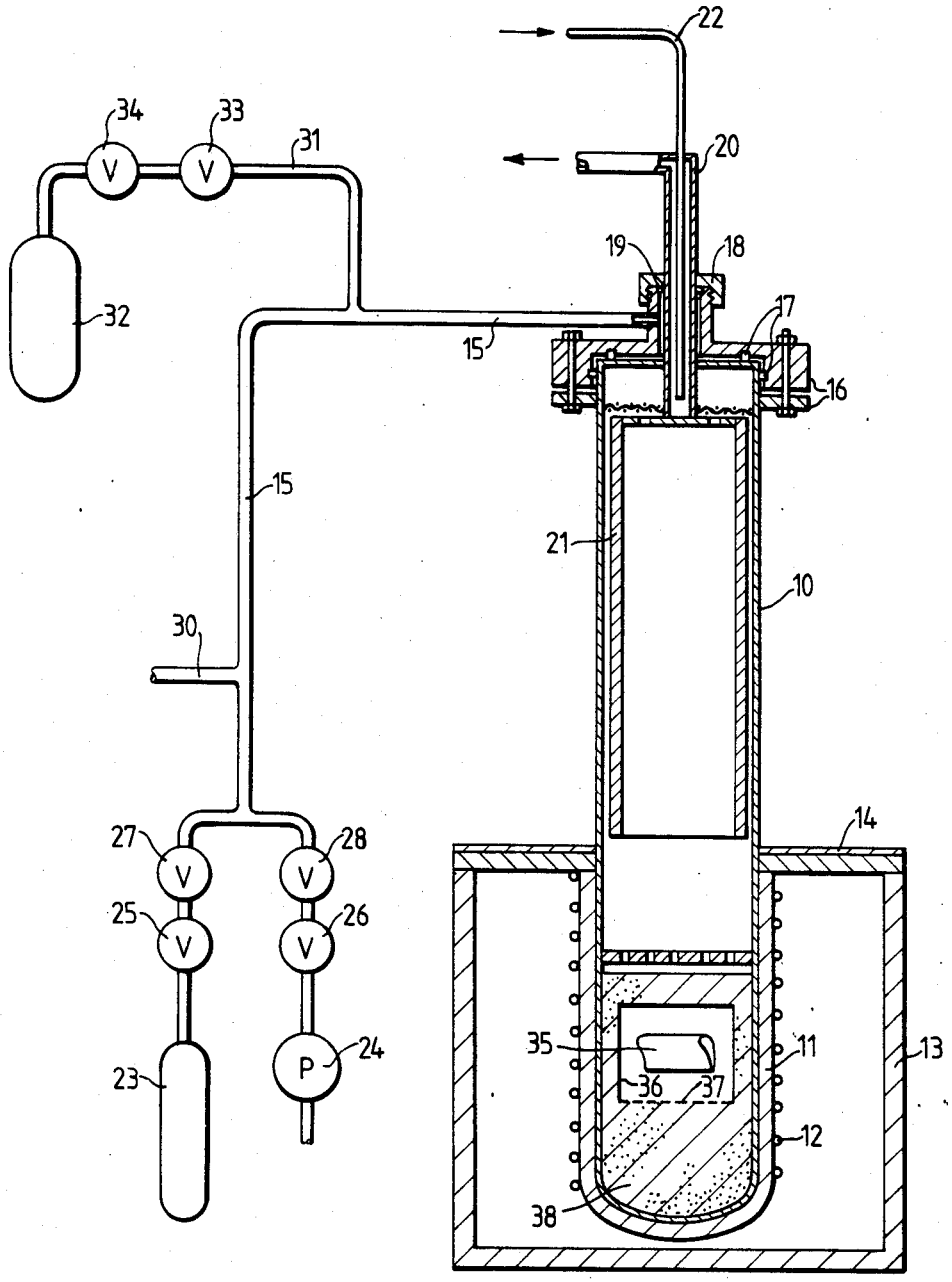
22
20
34
33
31
V
V
19
18
32
17
15
16
15
21
10
30
14
27
28
V
V
25
26
V
V
35
11
13
P
24
23
36
37
12
38

PROCESS FOR DIFFUSION COATING METALS

The invention relates to the field of protective coatings for metals, such as anti corrosion coatings, especially for metals which may be subject to a high temperature oxidising and corrosive environment. It concerns such coatings as contain more than one constituent element and are deposited by a chemical vapour deposition process. The process of the invention is especially, though not exclusively directed to protective coatings for superalloys such as aluminium-silicon coatings or aluminium-chromium diffusion coatings.

The superalloys constitute an internationally recognised group of materials developed for high performance applications involving relatively high stresses and temperatures generally above 540° C. where resistance to oxidation and corrosion is required, and having a composition based on nickel, cobalt, iron or nickel plus iron, with chromium as an alloying ingredient.

Many such superalloy materials intended for use in the hot section of gas turbine engines are optimised for the best combination of high temperature strength and creep resistance and this optimisation is achieved at the expense of an increased susceptability to high temperature surface degradation caused by oxidation and corrosion. This increased susceptibility to surface degradation is consequent upon a low chromium content. It is well known that the resistance to surface degradation in a superalloy component may be improved by applying a protective coating to that component. Diffusion coatings based on aluminium have been much used and it is known that diffusion coatings may be based on aluminium in conjunction with other materials such as chromium or silicon. Diffusion coatings rely upon interdiffusion between deposited material and the substrate material for the establishment of the protective properties of the coating. Diffusion coating process for aluminium deposition may be categorised, albeit on a somewhat arbitrary and inexact basis, into the 'high activity' processes and the 'low activity' processes with the difference between these being that the former relies more on inward diffusion (from coating to substrate) than outward diffusion and that the latter relies on the opposite. An alternative type of coating for superalloys is that termed the 'overlay coatings'. These coatings rely less on interdiffusion between substrate and coating than the diffusion coating, for the protection is an inherent property of the deposited material—which is an alloy e.g. a M Cr ALY allow where least one of the group consisting of nickel, cobalt and iron. This invention relates to a method for depositing materials intended as a diffusion coatings but it has relevance also to the field of overlay coatings in that it may be used to provide a supplement to an overlay coating.

It is known that diffusion coatings may be applied to components of such materials as superalloys by chemical reaction from the vapour phase (hereinafter called chemical vapour deposition and abbreviated to CVD) as distinct from physical vapour deposition e.g. by condensation. Early CVD processes for coating superalloys relied upon embedding a component within a pack of solid reactants which for an aluminising process might typically contain 10 weight percent aluminium powder, 3 weight percent ammonium chloride activator and balance alumina powder as diluent. The process would operate at a temperature (e.g. in the range 750°-1050° C.) at which the aluminium was molten but the aluminium would be largely held by surface tension to the diluent. Such a process would rely largely on vapour phase transport of the aluminium by the activator although there is likely to be some liquid phase transport from molten aluminium close to the component. The in-contact methods of chemical vapour deposition tend to produce alumina inclusions in the coating which are generally undesirable. The above-mentioned processes are frequently termed pack cementation processes and one example of such a process is disclosed in US Pat. No. 3,257,230. A general discussion of the chemistry of these processes is provided in a paper presented by P. N. Walsh at the Chemical Vapour Deposition Fourth International Congress Oct. 8-11 1973 which is reproduced in a publication of The Electrochemical Society Inc. More recently CVD diffusion coating has been achieved in an 'out of contact' mode—that is without contact between the pack materials and the component to be coated. Obviously such a process relies solely on vapour phase transport. An out of contact process of the Applicant is described in UK Pat. No. 1549845. This process utilises pressure pulsing of the chamber atmosphere (argon+reactants) for improvement of the control and throwing power of the process.

The current invention is concerned with the problems posed by deposition by CVD of a coating, such as a superalloy diffusion coating, containing more than one element. It is known that superalloys have been given diffusion coatings enriched with more than one element such as aluminium with chromium or aluminium with silicon. It has even been claimed that aluminium has been co-transported with chromium. However it is considered that such simultaneous co-transport of aluminium and chromium is not achievable through a halide transport route because of the chemical and thermodynamic disparity between the halide components of the elements. Similar problems are likely to affect co-transport of other element pairs to a greater or lesser extent. It should be noted that the efficiency of a halide CVD process, especially an out of contact process, is dependent upon the appropriate equilibrium environment in terms of chemistry and thermodynamics. In order that vapour phase transport may take place at all via the conventional halide route there must be present an active source of the metal to be transported, and also that metal must react with the halide activator to produce a suitable metal halide having some reaction pressure at the reaction temperature. A transport reaction such as the one given below:

$$AlF_3 + 2Al \times 3AlF$$

is a reversible reaction and net transfer of aluminium from the source to the component will only occur if the source is more thermodynamically active with respect to the aluminium than the coating deposited on the component. The activity of the deposited aluminium will be reduced by 'pinning' reactions with substrate elements, e.g. nickel. The activity of the source is dependent upon the state of combination of that source. Simultaneous co-transport of two elements from a source by a halide transport reaction will generally be ineffective because it is unlikely that the two will generate comparable reaction pressures at the same temperature.

Against this background, the claims made in regard to processes in the art for coating of superalloys through CVD of two elements by simultaneous co-transport should be treated with due circumspection. A lack of ability to transport an element such as chromium when co-transport with aluminium is sought, may be masked by the presence of chromium from the substrate. It should be observed also that mixed element sources are often found in CVD reaction charges for reasons other than co-deposition e.g. for moderating the activity of one of elements to a more controllable level.

An alternative way of producing mixed element diffusion coatings is by application of the elements in a slurry or aqueous dispersion. An aluminium-silicon coating may be produced by this route, and one is commercially available under the trade designation SERMALOY J. This latter coating is applied directly to the substrate article in the liquid which is then removed by evaporation before the article is heat treated to induce diffusion of the coated elements into the substrate. Such processes do not rely upon a halide transport reaction nor are they CVD processes.

The Applicant believes that current commercial requirements for mixed element diffusion coatings for superalloys and the like are being met by either a process of the SERMALOY J type or by halide CVD of the individual elements in distinct and separate process steps. The halide CVD process offers potential advantages over the wet coating route in terms of consistency of coating around uneven profiles and susceptability to automation. However this advantage can only be realised to the full if a process can be devised that requires only one operation of plant rather than the two currently employed.

Accordingly the present invention provides a process for transporting two elements in consecutive sequence each from a source to a metal article using a halide vapour transport reaction under an inert or a reducing covering atmosphere, by which transport a diffusion layer enriched with the two elements is formed at the surface of the article, wherein the process comprises the following steps:

i. introducing into a reaction vessel a reaction charge, including a source for at least a first of the two elements in elemental or chemically combined form and a halide activator in a proportion substantially in excess of that required by stoichiometry for complete exhaustion of the source of the first element, and locating the metal article within the reaction vessel;

ii. providing the covering atmosphere within the reaction vessel and raising the temperature within the reaction vessel to a reaction temperature at which a product of the activator and the first element has a significant reaction pressure;

iii. transporting to the metal article to produce a net deposition thereon the first of the elements which transportation is achieved without any net deposition of any other element;

iv. terminating the transportation of the first element upon or by exhaustion of its source in the reaction charge; and v. thereafter transporting to the thus previously treated metal article a second of the two elements to produce a net deposit thereof on the metal article which transportation is achieved without any net deposition of any other element.

Whilst it is feasible that other elements might be added to a two element diffusion coating produced by the process of the invention, either as a separate process step or by extending the one step operation to encompass a third deposition stage, the invention is of principle application to two-element coatings. The article which is located within the reaction vessel may be a superalloy article.

The reaction charge will encompass a source for each of the two elements. In one preferred form of the invention a reaction charge including both sources and the halide activator is introduced into the reaction vessel prior to commencement of the deposition stage for the first element. In this form of the invention the order of deposition will be dependent upon which element is the more electropositive of the two if there is a significant difference between the two elements in this regard. In the absence of other overriding factors, the first element to be deposited will be the more electropositive of the two. However no natural order can be predicted with certainty on the basis of electropositivity if there is not a significant difference between the elements in this regard. In such circumstance the order of disposition is open to the influence of the process parameters such as choice of the halide activator and of reaction temperatures. For such pairs of elements, a halide activator is used which enables one element from the source to develop a much greater halide product reaction pressure than the other at the temperature of reaction for the first deposition stage. Preferably the temperature of reaction is varied between the two deposition stages so that for each element at its respective reaction is varied between the two deposition stages so that for each element at its respective reaction temperature there is an optimised reaction pressure for that element. One preferred pair of elements is aluminium and chromium, however the most preferred pair is aluminium and silicon. For both pairs aluminium trifluoride ($ALF_3$) is a preferred activator. It has been found that $AlF_3$ will transport aluminium in preference to silicon to the exclusion of the latter for all practical considerations. A temperature of 925° C. is preferred for the transportation of aluminium by $AlF_3$ and a temperature of 900° C. for the tranportation of silicon by the same activator. An inert diluent such as alumina will be provided with the reaction charge to ensure that the particulate reactants do not fuse on heating.

An alternative form of the invention is one in which a source for the second element is introduced into the reaction vessel subsequent to the termination of the first deposition stage by introducing that source as a gas. A gas such as $SiCl_4$ or $SiF_4$ is suitable for providing a transport reaction for silicon as the second element. Such a transport mechanism may enable a greater or more rapid transfer of the second element than could be achieved from a source within the original reaction charge.

The transportation of the first element in the sequence may be terminated by natural exhaustion of the source in the reaction charge consequent upon the transport reaction. However such natural exhaustion is unlikely to be susceptible to the degree of control precision as might be required for at least gas turbine applications. It is therefore preferred that the termination is induced by evacuation of the reaction vessel which may be commenced at a predetermined point in the process whilst the first element is still being transported at a significant rate. The evacuation stage thus commenced can be maintained for as long as might be required to give confidence that the source of the first element is exhausted in order that the second tranportation stage might occur without interference. By this means the transportation is reduced to a series of discrete though continuous stages which are less susceptible to variation caused by minor variations in the proportions or the quantity of the reaction charge. An evacuation stage of 3–4 hours at a vacuum of 5–10 torr is preferred.

An important feature of the invention is that it creates a diffusion coating process by which two or more elements may be transported with predictable results within one operation of plant; that is without any intervening cooling of the substrates, handling of the substrates or the like. This aim is important for reasons both of economics and quality. However, economics and quality drive all researchers and there is ample evidence of continued effort devoted to the improvement of diffusion coating. The Applicant believes that despite these common motivating factors and a relevant background, others have not been led to the process of the invention. One reason for this is that many processes have been offered for simultaneous co-transport with little realisation of the chemistry and thermodynamics, of such processes and with results masked by outward diffusion. Another reason is that the current invention departs from established practice. Hitherto general practice, as evidenced at least by the aforementioned paper of P. N. Walsh, is to use a source which remains substantially undepleted during the transport reaction in order to provide sufficient source activity for the transport reaction to proceed in the desired direction at a reasonably constant rate. In contrast significant depletion of at least one element source is inherent in the process of the invention. The activity of the first element when deposited upon the component is greatly reduced upon combination with substrate elements to form a coating, and complete exhaustion of the first source need not be accomplished by transportation to the substrate but can be induced by evacuation. Another departure from tradition made by the process of the invention is in the use of a much greater proportion of activator in relation to the quantity of element source. This is another aspect of the previously mentioned departure from established diffusion coating practice.

It is prefered that the process be performed in an out of contact manner in order that inclusion or adherance of pack materials is avoided and in order that there is no contact between reactant source and article which could give rise to non-uniformities resulting from transport out of the vapour phase. This out of contact operation can be achieved by placing the articles outside, but close by, the body of the charge. Alternatively the articles can be enclosed within a metal gauze particle excluder and placed within the body of the charge. This latter technique, although adopted for the small scale experiments reported elsewhere herein, is not the preferred option for full-scale work.

It has been demonstrated that the process of the invention can be utilised very effectively in conjunction with a pulsed pressure regime of the type described in UK Pat. No. 1549845. Whilst pulsed pressure operation is particularly beneficial in applications which demand the known attributes of the prior art process—greater throwing power for coating of inaccessible cooling channels and passageways. However pulsed pressure operation is beneficial for other reasons. By inducing forced movement of the gaseous reactants and the covering atmosphere it reduces the importance of minimising the transport distance and ensures that the gas atmosphere is circulated all round the components. This leads to an improvement in the quality and consistency of coating both between individual articles in the reaction vessel and between different surfaces of individual articles. The pulsed pressure regime is operated at a comparatively low pressure, with pulsing between say 20 and 50 torr or over slightly greater range. This practice is followed in order to avoid the movement and/or wastage of excessive quantities of gas. For such practise a low volatility activator is required in order to avoid premature exhaustion. However the process is not restricted to pulse pressure operation nor is it limited to an out of contact manner. For other uses of the process especially the reaction may be operated a pressures around atmospheric pressure as adopted in many prior art processes and for these higher pressure varients a high volatility activator will be required. Many activators of both the low volatility and high volatility varieties are disclosed in the aforementioned UK Pat. No. 1549845 and others will be known to those skilled in the art. A frequency in the range 3–10 cycles per minute is preferred.

The process of the invention can be utilised for the provision of an aluminium based two element diffusion coating upon a superalloy article already bearing an overlay coating of the MCrAlY type for improvement of the overlay coating as is described in European patent No. 0 024 802.

As has been mentioned previously the process of the invention is not limited to superalloy aplications. Other potential applications currently known to the Applicant include coating felts such as Ni/Cr felts for high temperature corrosion protection of seals, and coatings for niobium-based or tantalum based alloys in space-craft applications.

The invention is now described in greater detail with reference to several illustrative examples and with reference to the accompanying drawing.

The drawing shows a schematic representation of one form of apparatus suitable for performing the process of the invention. The apparatus shown comprises a reaction vessel 10 which is a retort made of mullite material seated at its lower end within an alumina tube 11 which tube is itself surrounded by a heating element 12. The alumina tube 11 and heating element 12 are contained within a thermally insulated furnace box 13 having a nickel foil heat shield 14 on its upper surface. At its upper end the retort 10 is connected to auxiliary equipment by a pipe 15. The pipe 15 is connected to the retort 10 by an end plate and flange assembly 16 which includes 'O' ring seals 17. On top of the end place is a screw cap 18 having an 'O' ring seal 19. Passing through and sealed to the cap 18 is a tube 20 which at its lower end within the retort 10 is connected to a hollow cylindrical condensing member 21. A further tube 22 is concentric with the tube 20. Tubes 20 and 22 carry cooling water to cool the condensing member 21. The member 21 also serves to cool the upper part of the retort 10.

The auxiliary equipment comprises a supply of argon 23 and a vacuum pump 24 connected to the pipe 15 via time controlled shut-off valves 25 and 26 and flow-rate control valves 27 and 28. A pressure gauge 29 (not shown) is connected to the pipe 15 by a pipe 30. A pipe 31 connects a supply of gaseous halide activator 32 to the pipe 15 via a flow-rate control valve 33 and a shut-off valve 34.

In the lower end of the retort 10 within the furnace box 13 is the article to be coated 35. The article 35, a gas turbine engine blade, is contained within a fabricated nickel-alloy or stainless steel particle excluder 36 having on its lower face a mesh wall 37 which allows ingress and egress of coating gases. The particle excluder 36 and article 35 are surrounded by a pack 38 the composition of which will be described in the examples below.

Temperature control of the pack 38 and article 35 may be by any known method. Apparatus in the form described above has been used in the performance of the method of the invention as described below with reference to particular illustrative examples.

EXAMPLE 1

A Ni monic 108 (trademark) superalloy turbine blade having cooling channels within the blade was used as the specimen to be coated. The nominal composition of Ni monic 108 superalloy is 15Cr-1.2Ti-4.7Al-19Co-5Mo balance essentially Ni with C-0.2 max, Si 1.0 max, Cu 0.5 max, Fe 2.0 max and Mn 1.0 max; all in proportions by weight. The specimen was placed inside a stainless steel particle excluder and loaded into the reaction vessel together with a reaction charge of solid reactants such that the specimen was located within the body of the charge. The charge comprised a homogenous mixture of the following: 29 g $AlF_3$, 5 g Al flake, 7.5 g Si powder and 1 kg of tabular $Al_2O_3$. The loaded reaction vessel was then evacuated of air and back-filled with argon. The heater was used to raise the temperature within the reaction vessel to 920° C. and at that reaction temperature the argon pressure was pulsed by cyclically evacuating gas from the reaction vessel then introducing fresh argon from the argon supply. The cycle parameters were as follows: frequency 4 c/m, upper pressure 60 torr and lower pressure 13 torr with equal time at both upper and lower pressures and negligiable changeover times. This cycle was maintained for the duration of an aluminising stage lasting 2 hours. Upon completion of that stage the aluminising transport reaction was suppressed by evacuation of the reaction vessel atmosphere down to a pressure of 5 torr or less which was then held (with the temperature remaining at 925° C.) for 3 hours. This evacuation stage was intended to exhaust all the aluminium source by conversion of the aluminium to gaseous AlF which is withdrawn from the reaction vessel. After the 3 hours, the reaction vessel was backfilled with argon to a pressure of 760 torr whereupon the vessel was sealed and the temperature lowered to 900° C.

This temperature was adopted as being one favourable to the transport of silicon using aluminium trifluoride activator. The siliconising stage was performed at near atmospheric pressure because no pulsing was involved and the mass transport criterion, which dictates a lower pressure for pulsed operation, did not apply.

Examination of the thus treated specimen revealed that it had a uniform layer of aluminium enrichment extending 30 μm into the specimen on all outer surfaces and a similar covering on the surfaces of cooling passages. The aluminium content across the layer averaged somewhere near 28 percent by weight. The specimen had a silicon enrichment to a depth of at least 10 μm over the external surfaces. This layer had an average silicon content of about 8.5 percent by weight. The layer of aluminium enrichment within the cooling channels was substantially free of silicon.

EXAMPLE 2

An experiment was performed which was a repeat of that described as Example 1 with a longer aluminising stage of 3 hours. All other process parameters were the same as given for Example 1.

Examination of the treated specimen revealed that it had a region of aluminium enrichment extending approximately 30 μm into the specimen on all outer surfaces. The alumnium content in this region averaged 28–30 percent by weight. An outer 10 μm of this region of aluminium enrichment contained silicon to a level of 9.5 to 11.0 percent by weight.

EXAMPLE 3

An experiment was performed which was based upon that described as Example 1 but with modified process times and pulsing parameters. The differences are identified below. The duration of the aluminising stage was 3 hours and 15 minutes. The pressure was pulsed between 19 torr and 49 torr for the duration of the aluminising stage. The evacuation stage lasted 3 hours and 15 minutes with the pressure 4–5 torr.

Examination of the specimen revealed that a aluminium enriched layer had formed over both the external surfaces and the surface of the cooling channels. On external surfaces the layer extended approximately 30 μm into the specimen and had an aluminium concentration in the range 28–30 percent by weight. The layer on cooling channel surfaces extended approximately 20 μm into the specimen and contained approximately 20–25 percent by weight of aluminium. A silicon enriched layer extending approximately 15 μm into the specimen was present on external surfaces. This contained approximately 10.75–15.0 percent by weight of silicon. The silicon enrichment was present in the cooling passages in the region close to their external openings to a depth of approximately 10 μm into the specimen with a silicon concentration of approximately 6 percent by weight.

EXAMPLE 4

This was a repeat of the experiment described as Example 3, identical in all respects therewith save that the specimen was a test pin of cast nickel superalloy which had been coated with a commercial overlay coating by plasma spraying. The overlay coating had the nominal composition 32Ni-21Cr-8Al-0.5Y-balance Co, in proportions by weight. This experiment was performed to test the ability of the process of the invention to produce alumino-silicon enrichment of superalloy components having conventional MCrAlY (where M is Ni, Cr or Fe) overlay coatings, as it has been found previously that the creation of an aluminium enrichment layer over such an overlay coating may yield beneficial results as is described in European Pat. No. 0024802.

Examination of the treated specimen showed that it had a layer of aluminium enrichment extending approximately 20 μm into the specimen, which contained approximately 29 percent by weight of aluminium. A outer region of approximately 15 μm was enriched with silicon to a level of approximately 15 percent by weight.

The above examples and other experiments performed by the Applicant have demonstrated that predictable and controlled compositions and deposition thicknesses can be achieved for two-element diffusion coatings by the process of the invention, through control of pack composition, the substrate areas and substrate orientation together with the major process parameters of times, temperatures pressures and pulse parameters. The Applicant has sufficient experience in deposition of single element diffusion coating to suggest that the process as described herein might be readily adapted by those skilled in the art to deposit aluminium-chromium coatings, other coatings, and coatings which require a pulsed process for both transportation stages.

The reaction charge used in all experiments reported here includes a halide activator in proportion which is three times that required by stoichiometry for complete reaction of the aluminium together with a quantity judged sufficient for the required degree of silicon transportation. It is considered that the activator should be present (at least when it is $AlF_3$) in at least twice the concentration required by stoichiometry for exhaustion of the aluminium—this demands a 3:1 $AlF_3$:Al weight ratio. Such a ratio should be sufficient to leave adequate activator for subsequent transport of siliconising at least when neither element is transported under pulsed conditions. Additional activator might be needed when the aluminium is transported under pulsed conditions. A failure to provide a sufficient excess of activator has been found to cause disruption of the second transportation stage.

We claim:

1. A process for producing upon a metal article a diffusion coating enriched with two elements by transporting the two elements singly in consecutive sequence from a source to that metal article without contact therebetween using a halide vapor transport reaction under an inert or a reducing covering atmosphere, wherein the transportation is achieved by essentially the following steps in unbroken sequence:

(i) introducing into a reaction vessel at least one metal article to be diffusion coated and introducing therein also a particulate reaction charge comprising an elemental or compound source for each of said two elements together with a halide activator reactable at a first process temperature with said sources such that a first of said elements generates a substantially greater halide product reaction pressure than does the second of said elements, the particulate reaction charge including a proportion of said halide activator substantially in excess of that required by stoichiometry for complete exhaustion of the source of the first element;

(ii) providing an inert or a reducing atmosphere in the reaction vessel;

(iii) raising the temperature within the reaction vessel to said first process temperature thereby causing transportation of the first element, said transportation producing a net deposition on the metal article of the first element without net deposition of the second element by virtue of the disparity between the pressures of reaction generated in the reactions between the halide activator and the respective first and second elements, and maintaining the first process temperature for so long as transportation of the first element is required;

(iv) terminating the transportation of the first element when sufficient of such transportation has been achieved, by evacuating the reaction vessel to a degree sufficient to exhaust the source of the first element by evacuation of its halide reaction product;

(v) providing an inert or a reducing atmosphere in the reaction vessel; and, (vi) adjusting, as necessary, the temperature within the reaction vessel to a second process temperature, identical to or different from said first process temperature, at which second process temperature the source of the second element is reactable with the halide activator in the absence of a source for the first element to generate a vapor product and maintaining this second process temperature to transport the second element to produce a net deposition thereof on the metal article of the second element without net deposition of the first element thereon.

2. A process as in claim 1, in which the first element is aluminum and the second element is silicon.

3. A process as claimed in claim 2 in which the source for aluminium is unalloyed aluminium and in which the source for silicon is unalloyed silicon.

4. A process as claimed in claim 3 in which the halide activator is aluminium trifluoride.

5. A process as claimed in claim 4 in which the transportation of at least one of the two elements is performed under the influence of imposed cyclic variations in the pressure of the atmosphere within the reaction vessel.

6. A process as claimed in claim 5 in which the aluminising stage is performed under said influence and in which the reaction charge contains at least three parts by weight of halide activator to every part by weight of aluminium.

7. A process as claimed in 1, in which the first element is aluminum and the second element is chromium.

8. A process as claimed in claim 1 in which the transportation of at least one of the two elements is performed under the influence of imposed cyclic variations in the pressure of the atmosphere within the reaction vessel.

9. A process as claimed in claim 8 in which said cyclic variations are between upper and lower pressures both substantially below atmospheric pressure.

10. A process as claimed in claim 9 in which the lower pressure is not greater than 20 torr and the upper pressure is in the range 50–100 torr.

11. A process as claimed in claim 10 in which the frequency of said cyclic variations is in the range 3 to 10 cycles per minute.

12. A process as claimed in claim 8 in which the first element is aluminum and the second element is chromium.

13. A process as claimed in claim 1 in which the metal article is enclosed in a particle excluder made of perforate metal and the thus enclosed article is located within the body of the reaction charge.

14. A process as claimed in claim 1 in which the metal article is located out of the body of the reaction charge.

15. A process as claimed in claim 26 in which a gaseous halide compound of the second element is introduced into the reaction vessel after the termination of the transportation of the first element.

16. A process as claimed in claim 15 in which the first element is aluminum and the second element is silicon.

17. A process as claimed in claim 16 in which the gaseous halide compound is silicon tetrachloride.

18. A process as claimed in claim 16 in which the gaseous halide compound is silicon tetrafluoride.

19. A process for producing upon a superalloy article an oxidation and corrosion resistant diffusion coating enriched with aluminum and silicon by transporting first aluminum then silicon singly in consecutive sequence from a source to that superalloy article without contact therebetween using a halide vapor transport reaction under an inert or a reducing covering atmosphere, wherein the transportation is achieved by essentially the following steps in unbroken sequence:

(i) introducing into a reaction vessel at least one superalloy article to be diffusion coated and introducing therein also a particulate reaction charge comprising unalloyed aluminum, unalloyed silicon, aluminum trifluoride as activator, and an inert filler, the aluminum trifluoride being present in the reaction charge in proportion substantially in excess of that required by stoichiometry for complete exhaustion of the aluminum component;

(ii) providing an inert or a reducing atmosphere in the reaction vessel;

(iii) raising the temperature within the reaction vessel to a temperature at which the aluminum and aluminum trifluoride react together to generate aluminum monofluoride vapor and maintaining this temperature to transport the aluminum by means of this vapor to produce a net deposition of aluminum on the superalloy article without any net deposition of silicon thereon;

(iv) terminating the transportation of the aluminum when sufficient transportation has been achieved by evacuating the reaction vessel to a degree sufficient to exhaust the aluminum component of the reaction charge by evacuation of said halide vapor product;

(v) providing an inert or a reducing atmosphere in the reaction vessel;

(vi) adjusting the temperature within the reaction vessel to a temperature at which the silicon component of the reaction charge, in the absence of an aluminum component, reacts with the aluminum trifluoride to generate a vapor product and maintaining this temperature to transport the silicon by means of this vapor product to produce a net deposition of the silicon on the superalloy article without net deposition of aluminum thereon.

20. A process as claimed in claim 19, in which the transportation of aluminum is performed under the influence of imposed cyclic variations in the pressure of the atmosphere within the reaction vessel, said variations being produced by alternating withdrawals of gas and introductions of fresh inert gas.

* * * * *